United States Patent [19]

Matsumoto et al.

[11] 4,344,697

[45] Aug. 17, 1982

[54] COPYING MACHINE

[75] Inventors: Hiroshi Matsumoto, Yokohama; Tomoki Ogura, Ayase, both of Japan

[73] Assignee: Tokyo Shibaura Denki Kabushiki Kaisha, Kawasaki, Japan

[21] Appl. No.: 252,193

[22] Filed: Apr. 8, 1981

[30] Foreign Application Priority Data

Apr. 11, 1980 [JP] Japan ..... 55-47790

[51] Int. Cl.[3] ..... G03G 15/00

[52] U.S. Cl. ..... 355/14 C

[58] Field of Search ..... 355/14 R, 14 C, 3 R

[56] References Cited

U.S. PATENT DOCUMENTS

| | | | |
|---|---|---|---|
| 4,099,860 | 7/1978 | Connin | 355/14 C |
| 4,162,848 | 7/1979 | Platt | 355/14 C |
| 4,202,622 | 5/1980 | Kawatsura et al. | 355/14 C |
| 4,273,439 | 6/1981 | Markham et al. | 355/14 C |

*Primary Examiner*—Richard L. Moses

*Attorney, Agent, or Firm*—Cushman, Darby & Cushman

[57] ABSTRACT

The copying machine according to the invention comprises a control section including a microprocessor constituted by a one-chip semiconductor high density integrated element, a random access memory for storing data and a read only memory in which a program for controlling the sequence of the copying machine is stored. The control section includes a timer. When the multiple copy mode is switched over to the interrupt copy mode, information of the suspended multiple copying run state is stored in the RAM, and the interrupt copy run is permitted. When no operation is made for a predetermined period of time after the end of the interrupt copy run, the remaining multiple copy run is permitted by reading out the suspended multiple copy run state stored in the RAM. When no operation is made for a predetermined period of time in the multiple copy mode, the machine set back to the normal mode that is brought about by system initialization after the closure of the power supply. The above control is effected according to the control program mentioned above.

6 Claims, 5 Drawing Figures

COPYING MACHINE

BACKGROUND OF THE INVENTION

This invention relates to copying machines which are capable of a multiple copy run and also in which an interrupt copy run can be caused during the multiple copy run.

The usual copying machine is constructed such that the multiple copy run for producing a desired quantity of copies can be caused by setting the desired quantity of copies, for instance with digital keys.

Recently, copying machines, which can be set to an interrupt copy mode permitting the interrupt copy run by closing a pause button during the multiple copy run, have been developed.

In this case, the interrupt copy state is brought about by closing the pause switch during the multiple copy run. Then, the interrupt copy run is caused by temporarily stopping the multiple copy run. Thereafter, the multiple copy mode having been suspended for the interrupt copy run is recovered by releasing the interrupt copy mode. By releasing the interrupt copy mode and turning on a clear key, a ready state (hereinafter referred to as normal mode) is set.

In this prior art copying machine, however, once the interrupt copy mode is brought about, this state is sustained indefinitely so long as no operation is made subsequently. In other words, the normal mode, in which the copying machine is most frequently used, is not automatically recovered after the interrupt copy mode is set.

SUMMARY OF THE INVENTION

An object of the invention is to overcome the above drawback in the copying machine, which is capable of the multiple copy run, and in which the interrupt copy run can be brought about during the multiple copy run. More specifically, it is an object of the invention to provide a copying machine, in which the multiple copy mode suspended by the establishment of the interrupt copy mode is recovered if no operation is made for a subsequent predetermined period of time, and also in which the normal mode if no operation is made for a predetermined period of time in the multiple copy mode.

To achieve the above objective, according to the invention there is provided a copying machine capable of being set to a normal mode, a multiple copy mode and an interrupt copy mode, comprising a power supply, data input means including a pause button for coupling information for switching the multiple copy mode over to the interrupt copy mode, a print button for coupling information for starting the copy run and digital keys for coupling the number of copies, display means for displaying the preset number of copies and the number of copies produced, control means including storing means for storing data from the data input means and information displayed on the display means and a timer for counting a predetermined period of time, the control means functioning to store the information displayed on the display means in the storing means while at the same time supplying a start signal to the timer for starting the counting thereof in response to interrupt copy mode information coupled from the pause button in the multiple copy run mode, read out the information stored in the storing means at the time of the multiple copy mode and display the read-out information on the display means to thereby resume the multiple copy mode if no data is coupled from the data input means during the predetermined period of time counted by the timer, supply the start signal to the timer for starting the counting of the timer when a copy start information is coupled from the print button in the multiple copy mode, and setting the normal mode if the multiple copy mode is not established or no information is coupled from the data input means during the predetermined period of time counted by the timer.

With the copying machine according to the invention, which is capable of being set to the multiple copy mode and also to the interrupt copy mode during the multiple copy mode, the multiple copy mode suspended by the establishment of the interrupt copy mode is recovered if no operation is made for a subsequent predetermined period of time. Also, the normal mode is recovered if no operation is made for a predetermined period of time in the multiple copy mode. Thus, the normal mode, in which the copying machine is most frequently used, can always be automatically recovered.

BRIEF DESCRIPTION OF THE DRAWINGS

The above and other objects and features of the present invention will be more apparent from the following description taken in connection with the accompanying drawings, in which.

DETAILED DESCRIPTION OF THE PREFERRED EMBODIMENT

Figure 1:
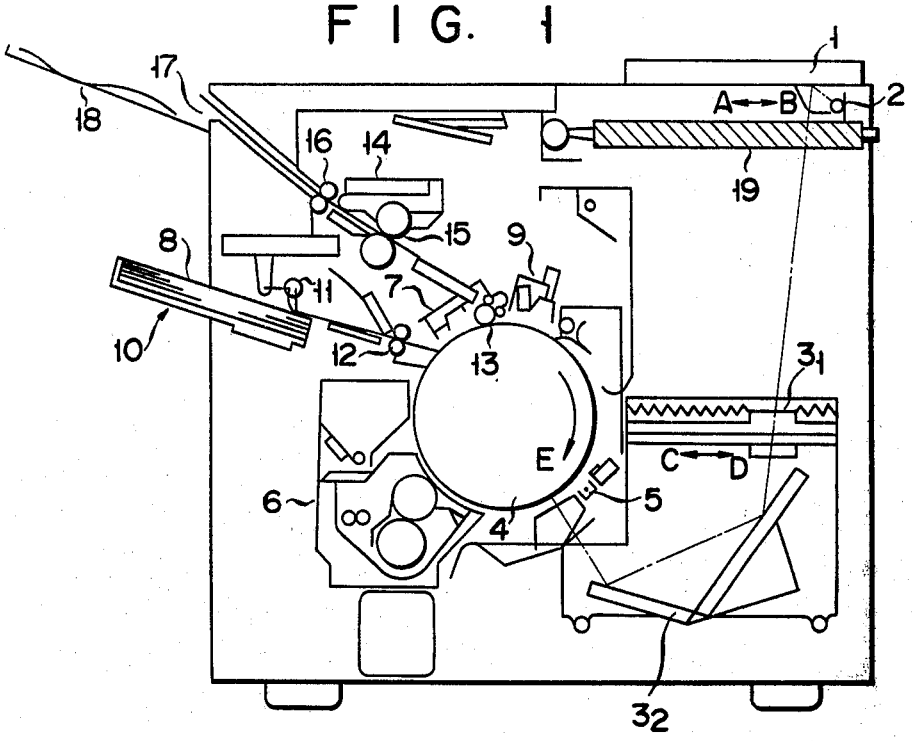
FIG. 1 is a schematic side sectional view showing one embodiment of the invention.

FIG. 1 schematically shows the internal construction of the copying machine. A document laid on a document support 1 is illuminated by light emitted from a light source 2 which is reciprocable in the directions of arrows A and B by a cam shaft 19. Light reflected from the document is transmitted through a lens $3_1$, which is reciprocable in the directions of arrows C and D together with the light source 2, and reflected by a mirror $3_2$ to reach a photosensitive drum 4. In this way, the light image of the document is focused on the drum 4. The drum 4 is previously charged by a charger 5 as it is rotated in the direction of arrow E before its slit exposure to the document image for forming an electrostatic latent image on its surface. The electrostatic image is developed into a visible toner image by a developing unit 6. The toner image is attracted to and transferred to a copying paper sheet 8 as the copying sheet is charged by a transfer charger 7. After the transfer of the toner image, the photosensitive drum 4 is reversely charged by a charger 9, whereby all the residual charges are removed.

The copying paper sheet 8 is taken out from a sheet feeder section, for instance a sheet feeder cassette, in synchronism to the rotation of the photosensitive drum 4 by a take-out roller 11 and fed to the transfer section by feed rollers 12. As the copying paper sheet 8 is fed to the transfer section, it is brought into close contact with a portion of the photosensitive drum 4 found at the transfer charger 7, and in this state, the toner image on the photosensitive drum 4 is transferred onto the copying sheet. After the transfer, the copying sheet 8 is fed to a fixing unit 14 by a feed roller 13, and the transferred image is fixed by a heat roller 15 in the fixing unit 14. Thereafter, the copying sheet 8 is exhausted from an exhaust outlet 17 by exhaust rollers 16 into a copy tray 18.

Figure 2:
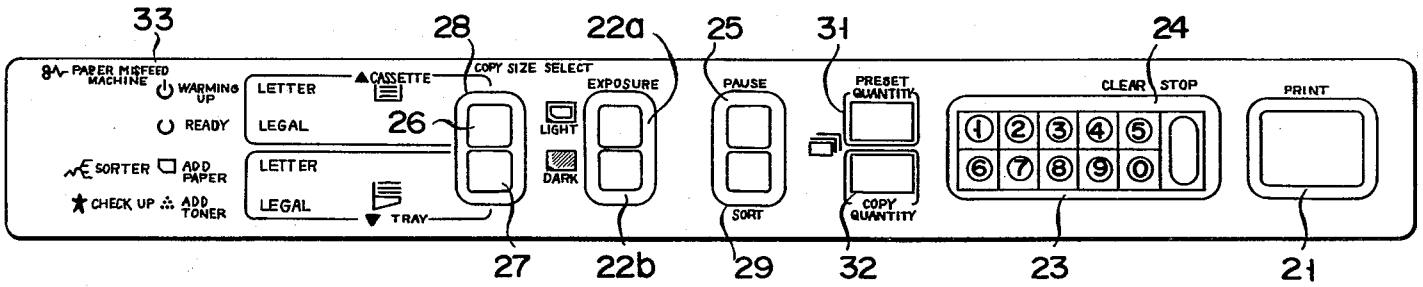
FIG. 2 is a plan view showing an operation panel of the copying machine according to the invention.

FIG. 2 shows a key operation panel of the copying machine described above.

The key operation panel has a print button 21 for specifying the start of the copy run, a light exposure button 22*a* for obtaining a copy of larger exposure, a dark exposure button 22*b* for obtaining a copy of small exposure, digital keys 23 for presetting the number of copies, a clear/stop button 24 for correcting an error keyed in or stopping the multiple copy run, a pause button 25 of self-illumination type for coupling information for setting an interrupt copy mode during a multiple copy mode, a copy size select section including a cassette button 26 of self-illumination type for selecting the cassette paper supply and a tray button 27 of self-illumination type for selecting the tray paper supply, and a sorter button 29 for selecting a sorting mode.

The display section includes a preset quantity display section 31 for displaying the preset quantity of copies and a copy quantity display section 32 for displaying the quantity of produced copies. It also includes a letter display section 33 shown at the left hand end of the Figure and having a "WARMING UP" lamp which is turned on with the closure of the power source until the copying machine is brought to the normal mode, a "READY" lamp for indicating the ready-to-copy state (normal mode), an "ADD PAPER" lamp for indicating the paper replenishment, an "ADD TONER" lamp for indicating the toner replenishment, a "MACHINE" lamp which is turned on at the time of occurrence of paper misfeed within the copying machine, a "SORTER" lamp which is turned on at the time of occurrence of paper misfeed within the sorter (not shown), a "CHECK UP" lamp which is turned on when the copy run for the preset quantity of copies is ended.

Figure 3:
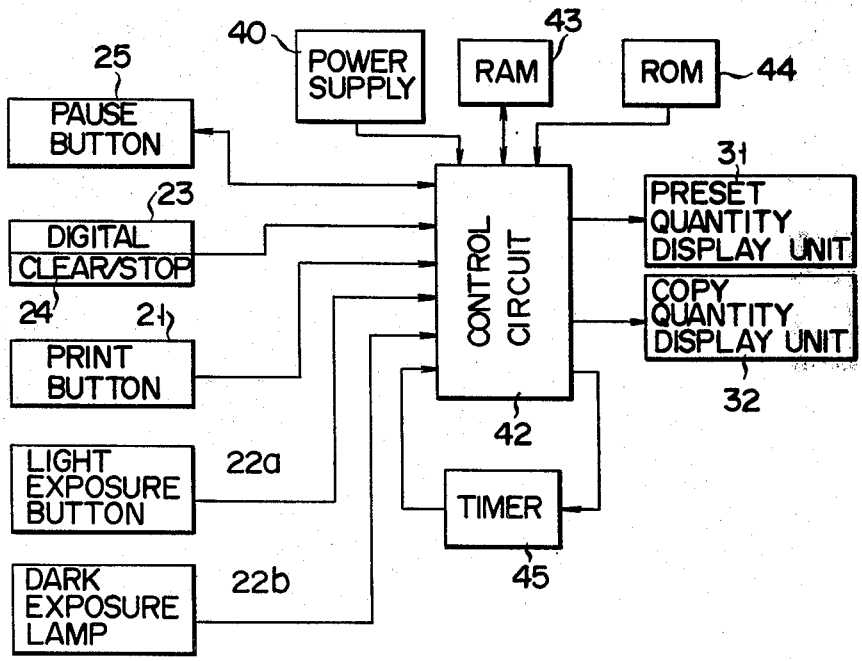
FIG. 3 is an electric block diagram showing the control system of the copying machine according to the invention.

FIG. 3 shows an electric block diagram of the control system for the copying machine according to the invention. Designated at 40 is a power supply. A control circuit 42 displays the preset quantity of copies according to the signal from the digital keys 23 mentioned above, and it causes the copying operation according to the signals from the print button 21, light exposure button 22*a* and dark exposure button 22*b* while causing the display of the quantity of the produced copies on the copy quantity display unit 32. It also causes a memory, for instance a random access memory (RAM) 43 to memorize the data displayed on the copy quantity display unit 32 and data displayed on the copy quantity display unit 32 according to the signal from the pause button 25. Further, all the copying paper in the copying machine is exhausted after stopping the paper supply, it sets the machine to an interrupt copy mode while also starting the operation of the timer 45. In the interrupt copy run mode, it causes the interrupt copy run to proceed according to the signal from the print button 21. When a signal is supplied from a timer 45 after the lapse of a predetermined period of time (for instance 30 seconds) without the print button 21 or digital keys 23 operated, it causes the multiple copy mode having been suspended for the interrupt copy run to be recovered, while causing the display of the display information at the time of the previous multiple copy mode to be read out from a RAM 43 and displayed on the preset quantity display unit 31 and copy quantity display unit 32. Further, when a predetermined period of time has elapsed without any signal coupled from the print button 21 or other input keys in the multiple copy mode, the timer 45 again supplies a signal, whereupon the control circuit 42, it causes the normal mode of the machine to be recovered while causing the display of the normal mode on the preset quantity display unit and copy quantity display unit.

Figure 4:
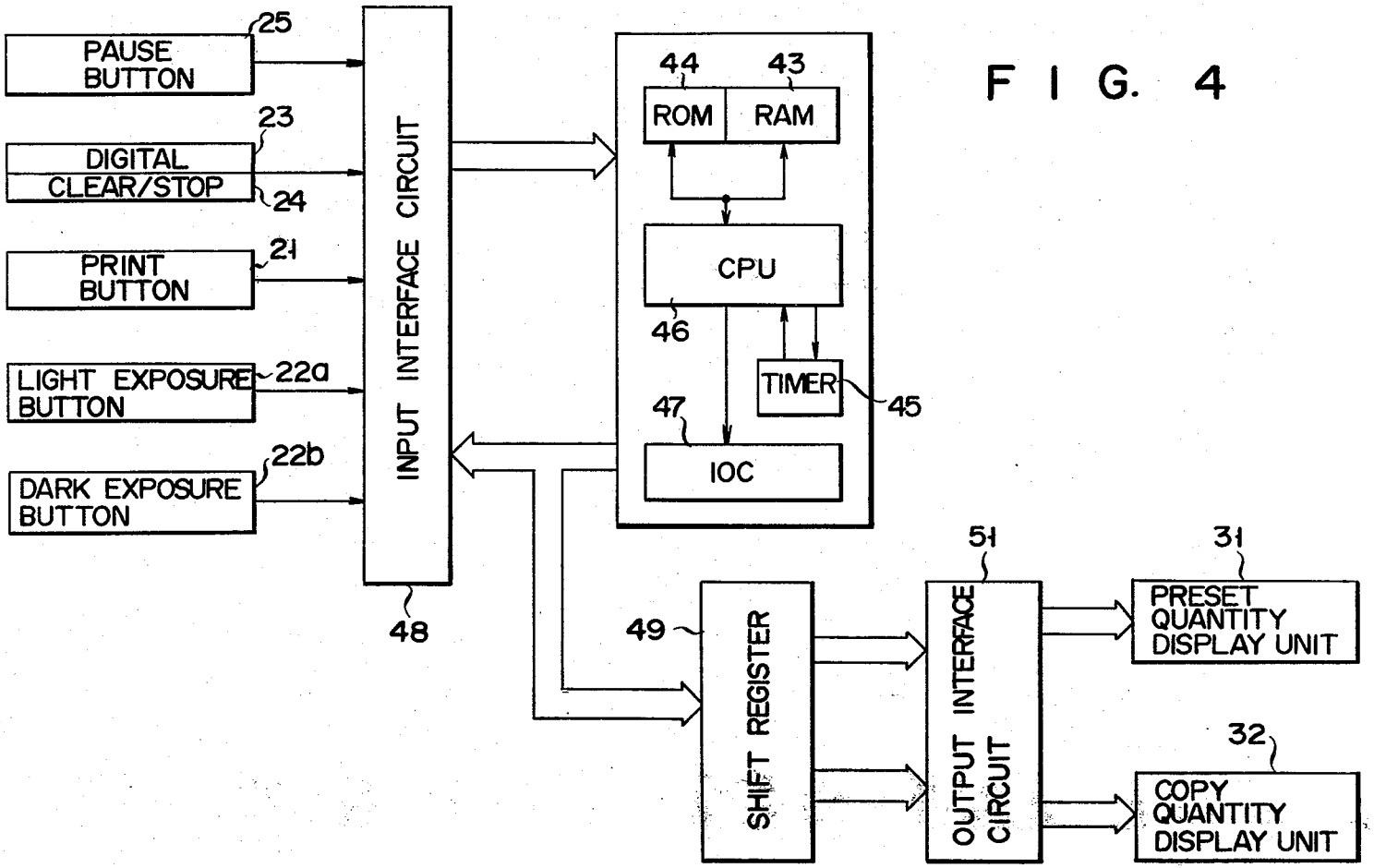
FIG. 4 is a block diagram showing the detailed construction of the control section in the electric block diagram of FIG. 3.

FIG. 4 is a block diagram showing the detailed construction of the control circuit 42 and peripheral circuits thereof shown in the electric block diagram of FIG. 3.

In the Figure, designated at 46 is a central processing unit which constitutes the essential part of the control circuit 42. Designated at 44 is a read only memory (hereinafter referred to as ROM) for storing the sequence program of operation of various copying processing sections such as paper feed, paper transport, charging, exposure, development and fixing sections. Designated at 43 is a random access memory (RAM), in which data required in a central processing unit (hereinafter referred to as CPU) 46 are stored. Designated at 47 is an input/output control section (hereinafter referred to as IOC) for the control of signal transfer between input/output devices and the CPU 46 and also data input/output control. In the instant embodiment, the CPU 46, ROM 44, RAM 43 and IOC 47 are constituted by a one-chip microprocessor. As such a microprocessor may be used a 4-bit microprocessor "TLCS-43" by Toshiba Incorporation. While in this embodiment a counter is provided as the timer 45, it is also possible to provide the RAM 43 with a count area for the counting according to the control program provided in the ROM 44. The pause button 25, digital keys 23, clear/stop key 24, print button 21, light exposure button 22*a* and dark exposure button 22*b*, these parts constituting the data input means mentioned above, are connected to the CPU 46 via an input interface circuit 48 for selecting inputs. The interface circuit 48 selects from the individual keys and switches for each group according to a 8421-code selection signal supplied from the CPU 46 and couples the selected input in the form of a binary code of either "1" or "0" to the CPU 46.

The data coupled from the data input means, for instance the preset quantity data coupled from the digital keys 23, is coupled through the input interface circuit 48 to the CPU 46 to be stored in the RAM 43. Further, the RAM 43 is provided with a count area for counting the copy quantity, and one count is added to the copy quantity every time a copy is produced. Under the control of the CPU 46, the preset quantity and copy quantity data are read out from the RAM 43 and temporarily buffered in a display shift register 49 through the IOC 47 to be supplied to the preset quantity display unit 31 and copy quantity display unit 32.

The CPU 46 progressively reads out the program stored in the ROM 44 and executes a predetermined sequence processing and also the necessary input/output control accompanying the processing. During this time, the transfer of various necessary signals or data between the CPU 46 and each copying processing section or operation panel is effected through the IOC 47 and input interface circuit 48. More particularly, the CPU 46 reads out the state signals or data from the individual processing sections and operation panel, which are to be coupled to the IOC 47, from the input interface circuit 48 and executes the program by discriminating the read-out data, thereby providing various control signals or data through the IOC 47 to the shift register 49. Further, the CPU 46 effects within it various data processings, stores these data or data obtained as a result of the processings in the RAM 43 and reads out the data stored in the RAM 43 if necessary.

The timer 45 is a counter which provides a control signal after the lapse of, for instance, 30 seconds from the instant when it is rendered operative. The timer 45 is supplied with keyed-in data from either button or keys in the data input means or with a reset signal and a start signal from the CPU 46 in the multiple copy run mode or interrupt copy run mode. Therefore, it provides an output signal to the CPU 46 after counting for 30 seconds without any copying operation made and without any signal coupled from none of the buttons or keys in the data input means. The CPU 46 functions in response to the control signal for restoring the multiple copy mode when the machine is in the interrupt copy mode or restoring the normal mode when the machine is in the multiple copy mode.

Figure 5:
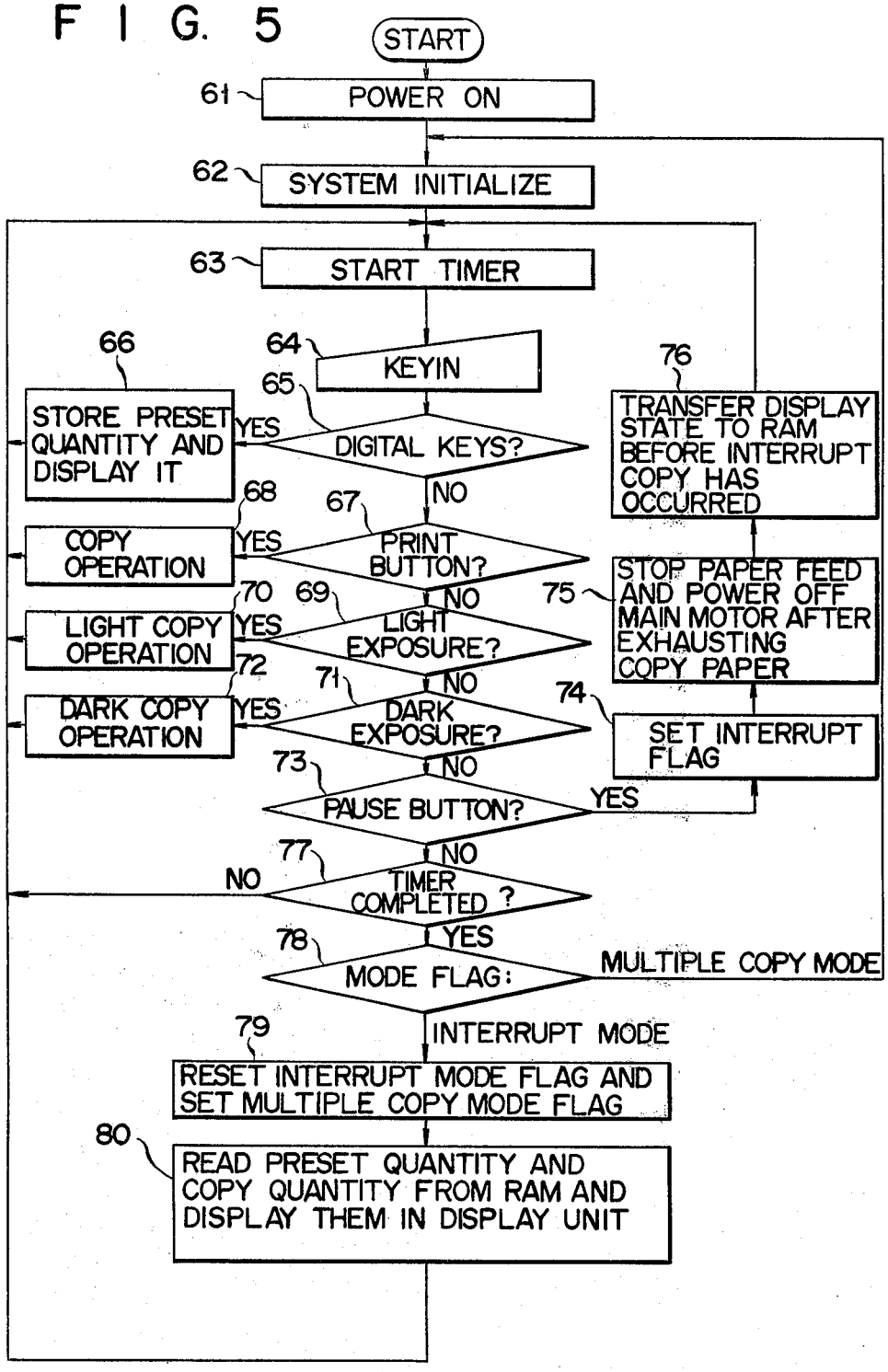
FIG. 5 is a flow chart for illustrating the operation of the control system for the copying machine shown in FIG. 5.

Now, the operation of the copying machine according to the invention will be described in detail with reference to the flow chart of FIG. 5. In the first place, the power supply is closed in a step 61. Then, in a step 62 the system is initialized. In this initialization step, the data of the preset quantity and copy quantity stored in the RAM 43 are cleared. In a subsequent step 63, the timer 45 is started. Thereafter, the keyed-in data are accepted (in a step 64). If at this time the quantity of copies for the multiple copy mode is preset by the digital keys 23, the preset quantity is displayed on the preset quantity display unit 31 (steps 65 and 66). Then it is detected in a step 67 that the print button 21 is depressed, the copy operation is effected in a step 68. More particularly, the main motor (not shown) is driven to rotate the photosensitive drum 4 in the direction of arrow E. After the lapse of a predetermined period of time, the take-out roller 11 and feed roller 12 are operated. When a copying paper sheet 8 is taken out from the paper feeder cassette 10, a copy quantity counter provided in the RAM 43 counts up "1", whereby "1" is displayed on the copy quantity display unit 32. At this time, the advancement of the light source 2 and lens $3_1$ is started. The take-out roller 11 and feed roller 12 are stopped to stop the copying paper sheet 8 of a position corresponding to the charger 7. When the light source 2 and lens $3_1$ are subsequently moved to a predetermined position, the rollers 12 and 13 are operated again to resume the transfer of the copying paper sheet 8. When the copying paper sheet 8 are transferred up to a predetermined position, the light source 2 and lens $3_1$ are retreated. At this time, the second copying paper sheet 8 is taken out from the paper feeder cassette 10. As a result, the counter in the RAM 43 counts up another "1", whereby "2" is displayed on the copy quantity display unit 32. When the light source 2 and lens $3_1$ are brought back to their start position, their advancement is caused again. Subsequently, the same operation as for the first copying paper sheet is performed for the second copying paper sheet. In the above way, copying paper sheets 8 are taken out one after another from the copying paper cassette 10 and exhausted after undergoing predetermined copying operation. If it is detected in a step 69 that the light exposure button **22*a* is depressed, copy operation for obtaining light copies is performed (in a step 70). If it is detected in a step 71 that the dark exposure button 22*b* is depressed, copy operation for obtaining dark copies is performed (in a step 72**).

It is now assumed that it is detected in a step 73 that the pause button 25 is operated during the aforementioned copy run with the preset quantity being, for instance, "00" and the copy quantity being, for instance, "55". The information from the pause button 25 is coupled through the input interface circuit 48 to the CPU 46. As a result, the CPU 46 turns on the pause button 25 and sets an interrupt copy mode (in a step 74). The setting of this mode is effected by setting an interrupt flag, for instance, in the RAM 43. Then, in a step 75 the CPU 46 produces a control signal for stopping the paper feed and cutting off power to the main motor after exhausting the copy sheet. Then, in a step 76 the CPU 46 transfers the information about the display state in the multiple copy run mode, i.e., the preset quantity of "100" and copy quantity of "55", to the temporary storage location in the RAM 43 and displays "1" on the preset quantity display unit 31 and "0" on the copy quantity display unit 32, whereby the interrupt copy mode is established. Subsequently, the CPU 46 resets and starts the timer 45 (in a step 63). Thereafter, every time the digital keys 23 are operated, the timer 45 is reset and started. When the print button 21 or exposure button **22*a* or 22*b* is operated, the timer is reset and started after the interrupt copy run is ended. If no information is coupled from the digital keys 23, print button 21 or exposure button 22*a* or 22*b*, a control signal is provided from the timer 45 to the CPU 46 (in a step 77). When it receives the control signal from the timer 45, the CPU 46 checks the mode flag in a step 78. If the interrupt mode flag is detected, the CPU 46 resets the interrupt copy run mode and sets the multiple copy mode flag in the RAM 43 (in a step 79). Then, the preset quantity and copy quantity data in the aforementioned multiple copy mode, stored in the temporary storage location in the RAM 43, are read out, that is, "100" is displayed on the preset quantity display unit 31 and "55" on the copy quantity display unit 32 (in a step 80). Thereafter, the remaining copy operation is in an enable mode. At this time, the timer 45 is reset and started again (in a step 63). Then, in the enable mode of the remaining copy operation if none of the print button 21, exposure buttons 22*a* and 22*b* or pause button 25 is operated during a subsequent predetermined period counted by the timer 45, the timer 45 provides a control signal to the CPU 46. As a result, the CPU 46** releases the multiple copy mode and sets the machine to the system initialized state, i.e., the normal mode.

What we claim is:

1. A copying machine capable of being set to a normal mode, a multiple copy mode and an interrupt copy mode, comprising:

(A) a power supply;

(B) data input means including (a) a pause button for coupling information for switching the multiple copy mode over to the interrupt copy mode, (b) a print button for coupling information for starting the copying, and (c) digital keys for coupling the data of the quantity of copies;

(C) display means for displaying the preset quantity of copies and the quantity of copies produced; and (D) control means including storing means for storing data from said data input means and information displayed on said display means and a timer for counting a predetermined period of time, said control means functioning to store the information displayed on said display means in said storing means while supplying a start signal to said timer for starting the counting thereof in response to interrupt copy mode information coupled from said pause button in the multiple copy mode, read out the information stored in said storing means at the time of the multiple copy mode and display the read-out information on said display means to thereby resume the multiple copy mode if no data is coupled from said data input means during said predetermined period of time counted by said timer, supply the start signal to said timer for starting the counting of said timer, and setting the normal mode if the multiple copy mode is not established or no information is coupled from said data input means during the predetermined period of time counted by said timer.

2. The copying machine according to claim 1, wherein said storing means is constituted by a random access memory, the content stored in said memory being cleared with the closure of said power supply.

3. The copying machine according to claim 1, wherein use is made of part of said storing means for said timer.

4. The copying machine according to claim 1, wherein said control means is constituted by a microprocessor formed as a single chip high density semiconductor integrated element.

5. The copying machine according to claim 4, which further comprises a read only memory in which a control program for executing the function as said timer is stored.

6. The copying machine according to claim 1, wherein said data input means further includes exposure buttons for obtaining lighten copies or darken copies and a clear/stop button for clearing the copy quantity data coupled from said digital keys or stopping multiple copy run.

* * * * *